US010914425B2

(12) United States Patent
Newman

(10) Patent No.: US 10,914,425 B2
(45) Date of Patent: Feb. 9, 2021

(54) COMBINATION VALVE ASSEMBLY WITH ACTUATABLE OVERFILL RELIEF

(71) Applicant: YSN Imports, Inc., Gardena, CA (US)

(72) Inventor: Shmuel Dovid Newman, Redondo Beach, CA (US)

(73) Assignee: YSN Imports, Inc., Gardena, CA (US)

( * ) Notice: Subject to any disclaimer, the term of this patent is extended or adjusted under 35 U.S.C. 154(b) by 0 days.

(21) Appl. No.: 14/267,082

(22) Filed: May 1, 2014

(65) Prior Publication Data

US 2014/0326328 A1 Nov. 6, 2014

Related U.S. Application Data

(60) Provisional application No. 61/818,853, filed on May 2, 2013.

(51) Int. Cl.
*F17C 13/04* (2006.01)

(52) U.S. Cl.
CPC ..... *F17C 13/04* (2013.01); *F17C 2201/0109* (2013.01); *F17C 2201/0119* (2013.01); *F17C 2203/0617* (2013.01); *F17C 2205/0323* (2013.01); *F17C 2205/0332* (2013.01); *F17C 2205/0385* (2013.01); *F17C 2205/0394* (2013.01); *F17C 2221/035* (2013.01); *F17C 2223/0153* (2013.01); *F17C 2223/033* (2013.01); *F17C 2225/047* (2013.01); *F17C 2260/022* (2013.01); *Y10T 137/309* (2015.04)

(58) Field of Classification Search
CPC ... B65B 31/044; F16K 17/168; F16K 17/048; F16K 1/306; F16K 24/04; F16K 24/02; B60K 2015/0451; F17C 13/04; F17C 2260/022; F17C 2225/047; F17C 2221/035; F17C 2205/0394; F17C 2205/0385; F17C 2205/0323; F17C 2201/0119; F17C 2201/0109; Y10T 137/309
USPC ..... 62/50.1, 50.7; 141/311 R; 222/3; 137/588, 590; 251/324
See application file for complete search history.

(56) References Cited

U.S. PATENT DOCUMENTS 934,037 A * 9/1909 Bunin ..... B60K 15/04 137/588
1,053,623 A 2/1913 McMillion
1,064,526 A 6/1913 Noe
1,137,209 A 4/1915 Henemier
(Continued)

*Primary Examiner* — Angelisa L. Hicks
(74) *Attorney, Agent, or Firm* — Lance M. Pritikin

(57) ABSTRACT

An exemplary embodiment of a combination valve assembly comprises a valve housing, an overpressure vent valve, a fill valve and a movable liquid overfill seal. The valve housing includes a longitudinal axis. The overpressure vent valve relieves excess pressure from the tank to which the assembly is affixed. The fill valve includes a fill valve pin actuatable between an open and closed configuration. The overfill seal is movable between a fluid sealing position and a fluid releasing position, and is elastically biased toward its fluid sealing position. In its fluid sealing position, the overfill seal prevents liquid from escaping the tank through the dip tube and outward of the valve assembly. Actuation of the fill valve pin toward its open position and movement of the overfill seal toward its fluid releasing position are preferably configured to both occur in the same direction, which is substantially parallel to the longitudinal axis.

4 Claims, 3 Drawing Sheets

(56) References Cited

U.S. PATENT DOCUMENTS

| | | | | | |
|---|---|---|---|---|---|
| 1,255,411 | A | | 2/1918 | Greenwald | |
| 1,305,263 | A | | 6/1919 | Earnheart | |
| 1,423,873 | A | | 7/1922 | Newsom et al. | |
| 1,434,708 | A | | 11/1922 | Kelsey | |
| 1,806,983 | A | | 5/1931 | Norgren | |
| 1,934,572 | A | | 11/1933 | Sutton | |
| 2,172,311 | A | * | 9/1939 | Rosswell | F16K 21/04 222/3 |
| 2,312,679 | A | | 3/1943 | Speth | |
| 2,376,628 | A | * | 5/1945 | Shanley | F17C 7/02 137/614.04 |
| 2,455,645 | A | * | 12/1948 | Barton | A61J 1/1412 137/559 |
| 2,478,760 | A | * | 8/1949 | Holicer | F17C 13/04 137/519 |
| 2,529,275 | A | | 11/1950 | Blumer et al. | |
| 3,018,914 | A | | 1/1962 | Webster | |
| 3,081,916 | A | * | 3/1963 | Rhodes | B65D 83/20 141/20 |
| 3,140,740 | A | | 7/1964 | Lagreid et al. | |
| 3,205,923 | A | * | 9/1965 | Wilson | F16K 24/04 137/588 |
| 3,359,994 | A | | 12/1967 | Lapointe | |
| 3,433,389 | A | | 3/1969 | Puster | |
| 3,454,033 | A | | 7/1969 | Smith | |
| 3,460,555 | A | | 8/1969 | Puster | |
| 3,491,786 | A | | 1/1970 | Bermingham et al. | |
| 3,537,622 | A | | 11/1970 | Baker et al. | |
| 3,542,062 | A | | 11/1970 | Jacobellis et al. | |
| 3,556,171 | A | * | 1/1971 | Gangwisch | B65D 83/42 141/20 |
| 3,747,626 | A | | 7/1973 | Valentino | |
| 4,246,930 | A | | 1/1981 | Bishop et al. | |
| 4,445,527 | A | | 5/1984 | Leimbach | |
| 4,597,410 | A | | 7/1986 | Wilke | |
| 4,669,497 | A | | 6/1987 | Tenhengel | |
| 4,760,865 | A | | 8/1988 | Rilett | |
| 5,181,977 | A | | 1/1993 | Gneiding | |
| 5,623,964 | A | | 4/1997 | Tsai | |
| 5,694,969 | A | | 12/1997 | DeVuyst | |
| 5,778,923 | A | | 7/1998 | Marston | |
| 6,003,547 | A | * | 12/1999 | Tippmann, Jr. | F16K 24/04 137/588 |
| 6,079,519 | A | | 6/2000 | Lottes | |
| 6,276,391 | B1 | | 8/2001 | Wu | |
| 7,073,527 | B1 | | 7/2006 | Teiga | |
| 7,404,412 | B2 | | 7/2008 | Milanovich | |
| 7,624,752 | B2 | | 12/2009 | Huang | |
| 8,176,931 | B1 | * | 5/2012 | Cajiga | B60S 5/02 137/234.6 |
| 2008/0264540 | A1 | | 10/2008 | Dowel | |
| 2009/0223580 | A1 | * | 9/2009 | Denis | F16K 1/306 137/614.19 |
| 2010/0282333 | A1 | | 11/2010 | Newman | |
| 2011/0114208 | A1 | | 5/2011 | Newman | |
| 2012/0091380 | A1 | | 4/2012 | Newman | |

* cited by examiner

COMBINATION VALVE ASSEMBLY WITH ACTUATABLE OVERFILL RELIEF

RELATED APPLICATIONS

This application claims the benefit of U.S. Provisional Application No. 61/818,853 filed May 2, 2013, the contents of which are incorporated by this reference in their entirety for all purposes as if fully set forth herein.

TECHNICAL FIELD

The present invention relates generally to the field of safety devices for the filling and venting of tanks for propane, butane, and other gases that are typically filled while at least primarily in the liquid state. More particularly, the present invention relates to valves and valve bodies in which both fill and pressure relief valves are mounted.

BACKGROUND

Safe operation of pressurized closed fluid systems requires a careful balance between maintaining the necessary pressure or fluid density to support the application of the system and avoiding exceeding the structural limitations of the system. This balance becomes particularly important when the system is designed for use by average consumers who may not be aware of how to avoid overfilling such a system or understand the risks posed by exceeding the pressure limitations of the system. Examples of such pressurized closed fluid systems include small tanks used to supply pressurized gas to recreational paintball markers and tanks used to store pressurized propane.

Prior propane valve assemblies have been proposed which combine fluid input, pressure relief and liquid overfill features. However, such prior expedients typically require the consumer or operator who is filling the tank through such a valve assembly to manually seal the overfill port in the valve assembly, by way of a bleeder set screw for example, upon completion of the filling process.

SUMMARY

A preferred embodiment of a combination valve assembly may comprise a valve housing, overpressure vent valve, fill valve and an overfill seal element. The valve housing member may preferably have a generally right cylindrical shape and include a first end, a second end and a longitudinal axis extending therebetween. The valve housing member typically has a vent valve socket, a fill valve socket and an overflow channel each of which may substantially extend from the second end toward the first end.

The overpressure vent valve may be disposed within the vent valve socket and have a pressure holding and a pressure relief configuration. The overpressure vent valve is typically elastically biased toward its pressure holding configuration. The elastic bias is typically adapted to being overcome by a fluid pressure at the second end in excess of a pre-determined safe value.

The fill valve may be disposed within the fill valve socket and have a fill valve pin actuatable between an open and a closed position. The fill valve allows fluid to flow therethough when the fill valve pin is in its open position. The fill valve is adapted to prevent fluid from flowing therethough when the fill valve pin is in its closed position. The fill valve pin is typically spring biased toward its closed position The overfill seal element is preferably movable between a fluid sealing position and a fluid releasing position. The overfill seal element prevents fluid from flowing through the overfill channel when in its fluid sealing position and allows fluid to flow through the overfill channel toward the first end when in its fluid releasing position. The overfill seal element is resiliently biased toward its fluid sealing position.

The aforementioned actuation of the fill valve pin toward its open position and movement of the overfill seal element toward its fluid releasing position are preferably configured to both occur in a direction substantially parallel to the longitudinal axis and toward the second end. Thus, such actuation and movement may occur simultaneously by virtue of interaction with respective components of the same fill adaptor.

BRIEF DESCRIPTION OF THE DRAWINGS

Further advantages of the present invention may become apparent to those skilled in the art with the benefit of the following detailed description of the preferred embodiments and upon reference to the accompanying drawings in which.

Figure 1:
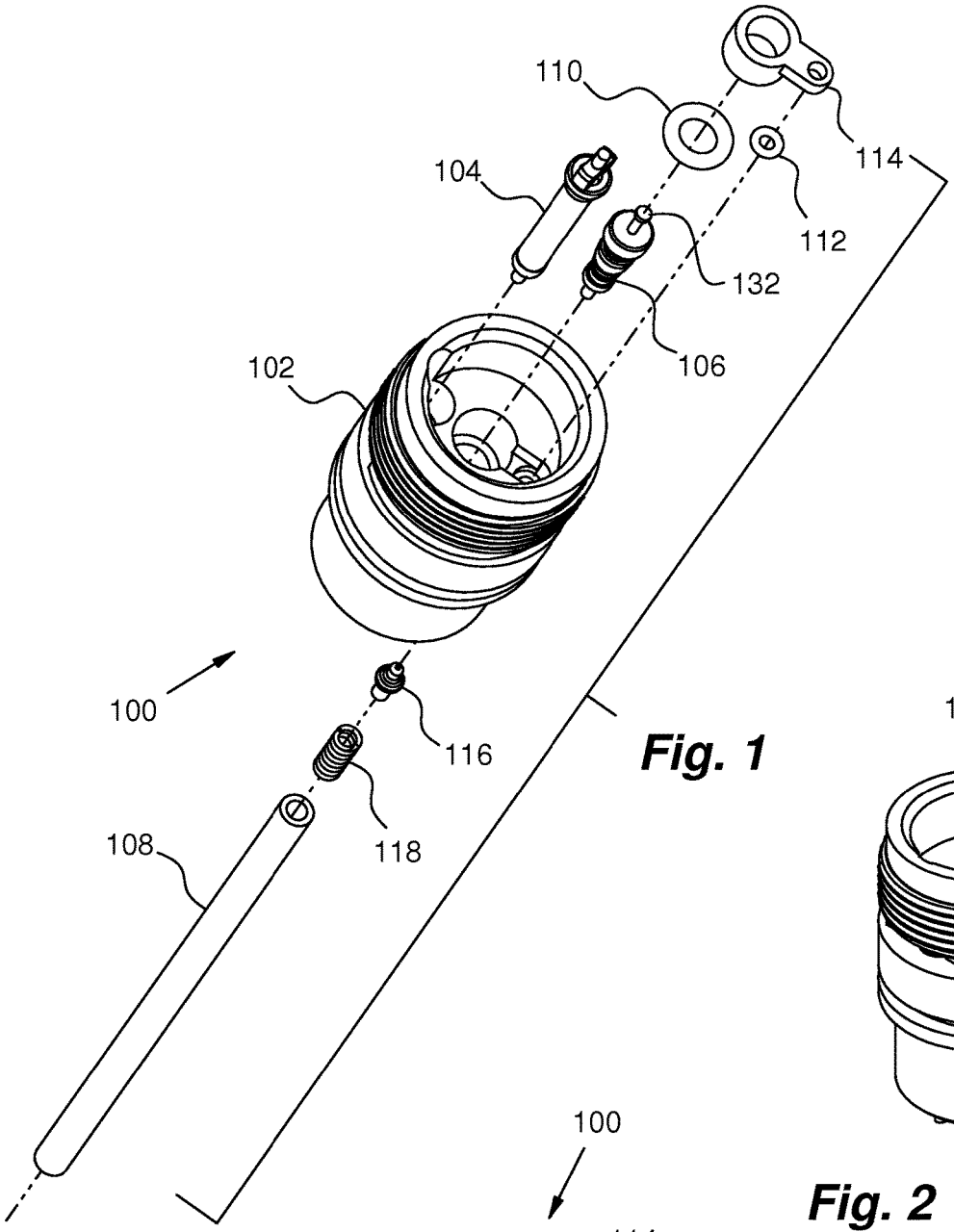
FIG. 1 is a diagrammatic exploded view of one non-limiting example of a combination valve assembly in accordance with the present invention.
Figure 2:
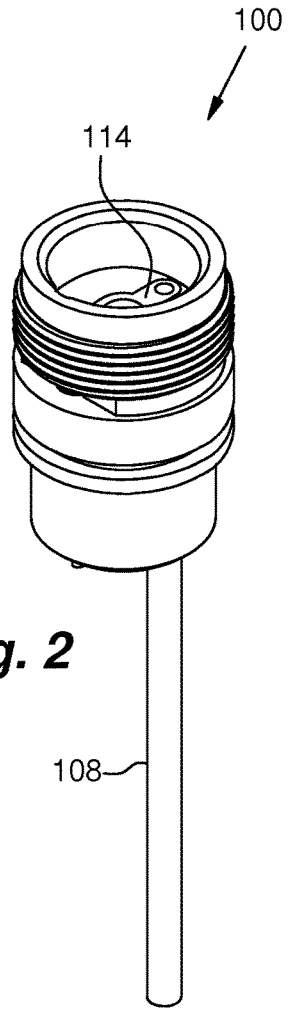
FIG. 2 is a diagrammatic perspective view of the combination valve assembly of FIG. 1, shown in collapsed or assembled state.
Figure 3:
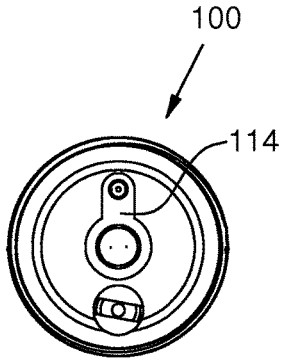
FIG. 3 is a diagrammatic top view of the combination valve assembly of FIG. 2.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications.

DETAILED DESCRIPTION OF THE PREFERRED EMBODIMENTS

The following description of preferred embodiments generally relates to combined fill and safety vent plugs. Such plugs serve to mount at least vent and fill valves in a single port in a pressure tank. Such plugs also provide for the mounting of dip tubes, when present, in a single port.

With particular reference to the figures, one or more non-limiting embodiments of a combination valve assembly with actuatable overfill relief are shown generally at 100. Embodiments of a combination valve assembly 100 may comprise a valve housing member 102, an overpressure vent valve 104, a fill valve 106, a dip tube 108, an annular seal element 110, a second seal member 112, a guide element 114, an overfill seal element 116 and a seal bias spring 118.

Valve housing member 102 is specially configured to mount an overpressure vent valve vent valve 104 in a vent valve socket 120, the fill valve 106 in a fill valve socket 122, and a dip tube 108 in an overflow channel 124. When certain embodiments are operatively sealingly joined to a mating port in a pressure vessel 126, the functions of filling, venting, dispensing, and overfill prevention are all incorporated into a single plug mounted in a single port. These functions are performed in such a way as to provide safe, simple, and easy filling, use, and refilling of pressure vessels. When used to dispense pressurized fluid for heating or other purposes, the device that consumes the dispensed fluid is typically sealingly joined through external thread 128 to the pressure vessel 126 that holds the fluid. Fluid flow arrow 130 indicates the flow of fluid outwardly through fill valve 106 in response to the opening of this valve (depression of fill valve opening pin 132) by a connection to a device (not shown).

Figure 4:
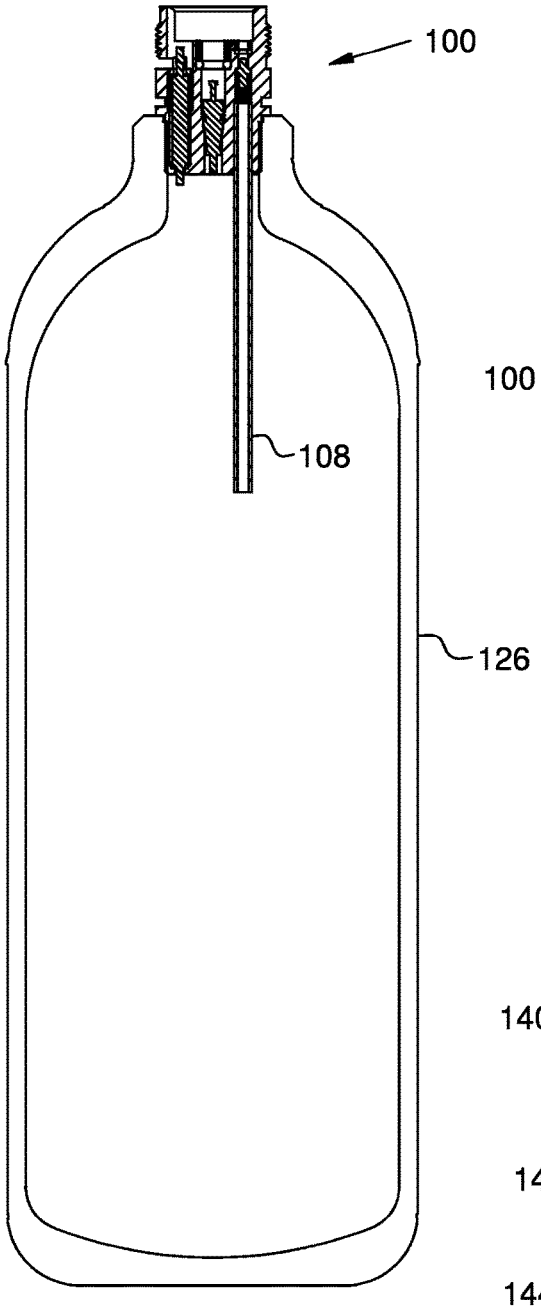
FIG. 4 is a diagrammatic cross-sectional view of the combination valve assembly of FIG. 2, shown valvingly mated to the neck of a pressure vessel.

Valve housing member 102 may have a generally right cylindrical configuration according to certain embodiments. A longitudinal axis 134 extends through the valve housing member 102 from normally external end 136 to normally internal end 138. Valve housing member 102 includes an external thread 128 on external portion 140. External thread 128 is adapted to threadably mate with a connection to a device that uses the fluid that is confined in an associated pressure vessel 126. If desired, external thread 128 may also threadably mate with a fill nozzle (not shown), although such a connection with a fill nozzle is often not used. Annular boss 142 serves to limit the depth to which valve housing member 102 may be inserted into a conventional port in a conventional pressure vessel 126. In embodiments where normally interior portion 144 is not threaded, annular boss 142 provides a convenient location for a weld to sealingly join valve housing member 102 to a mating annular wall of an annular port in a pressure tank (see, for example, FIG. 4). For thread bearing embodiments, annular boss 142 serves as a convenient location for a seal to seal valve housing member 102 to the mating annular end wall of a port.

Figure 5:
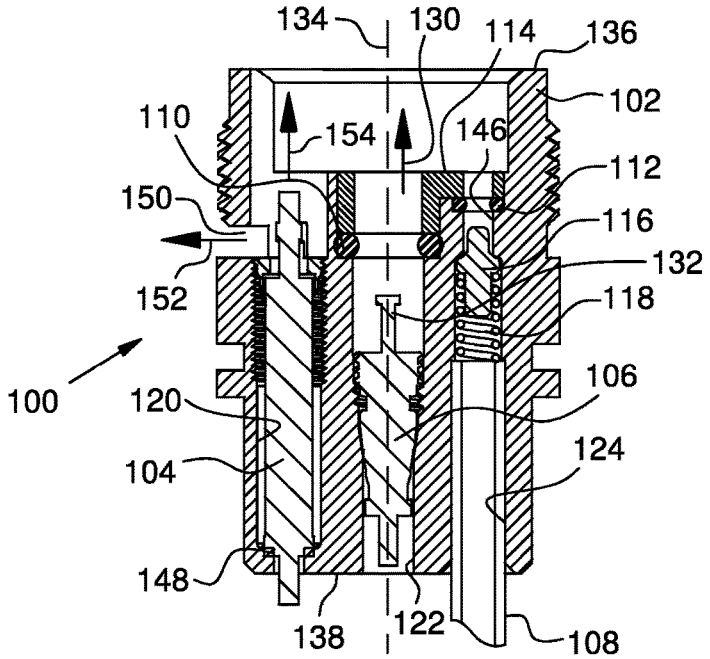
FIG. 5 is an enlarged partial cross-sectional view of the combination valve assembly of FIG. 2.
Figure 6:
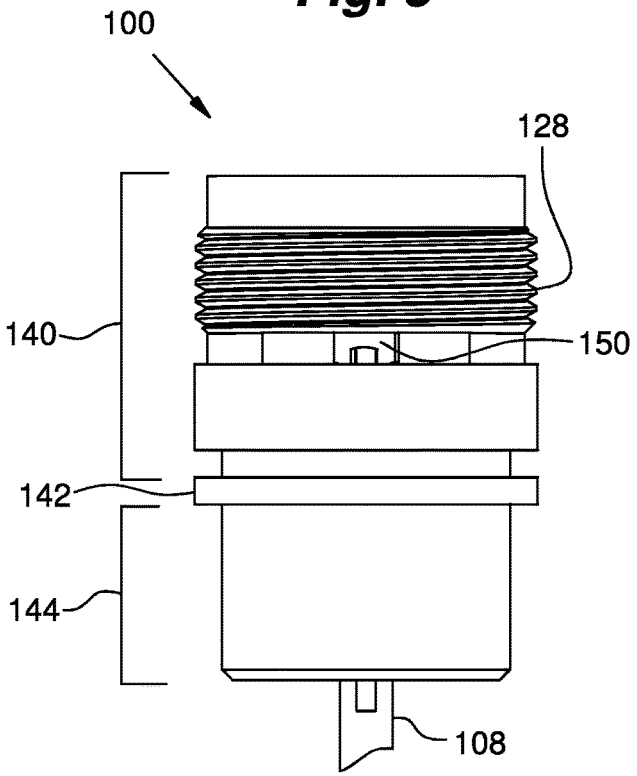
FIG. 6 is a diagrammatic side view of the combination valve assembly of FIG. 2.

The functions of filling, venting, use, and overfill protection in certain embodiments all involve fluid communication through valve housing member 102. Filling involves fluid communication into the interior of a closed pressure vessel from an external source by way of a nozzle (not shown) mated with the exterior portion 140 of valve housing member 102. The nozzle seals to valve housing member 102 upon being inserted into the normally external portion 140 of valve housing member 102 by sealingly engaging annular seal element 110. As illustrated in FIG. 5, seal 110 is confined in fill valve socket 122 by a generally annular wall and between an adjacent radially inwardly projecting boss and a guide element 114. The guide element may preferably be made of Delrin, s similar polymer, or the like. The nozzle pushes against fill valve opening pin 132 to overcome a spring bias that holds fill valve 106 in the closed configuration. This opens the fill valve 106. Fluid (either liquid or gas) is then free to flow from an exterior source through the nozzle, through the fill valve 106, and into the interior of a pressure vessel 126. Fill valves suitable for use according to the present invention are conventionally available. Fill valve 106 is only indicated diagrammatically in FIGS. 1 and 5 so that certain other aspects of the invention may be more clearly illustrated. In certain preferred embodiments, the fill valve 106 may be, for example, a Schrader valve or the like.

Particularly in those embodiments that are intended to be employed in the refilling of pressure tanks, and in other embodiments as well, overfill protection is provided by opening overflow port 146 during a filling operation. In those embodiments where dip tube 108 is inserted into overflow channel 124 and projects downwardly into the interior of a pressure vessel 126 for a predetermined distance, when a full condition exists within the pressure vessel 126, the respective liquid will overflow from the interior of a pressure tank and out of overflow port 146. In embodiments with a spring biased overfill seal element 116, such overflow will only happen while the overflow seal element 116 is forced against the bias of spring 118 and retained thereat. The overflow of liquid out of overflow port 146 also automatically prevents overfilling.

In those embodiments where overflow protection is provided, venting during filling may be provided by overflow out of overflow port 146. In those embodiments where overflow protection is not provided, safety concerns require the presence of a vent system that will be forced open by an amount of pressure within a pressurized tank that exceeds a predetermined amount. Also, all pressurized tanks should have a pressure vent system that will dump excess pressure out of the tank. When overflow port 146 is closed, for example, by spring-biased sealing of the overfill seal 116, it is necessary for safety purposes to have a pressure activated vent system.

Venting, according to certain embodiments, is accomplished by providing an overpressure vent valve 104. Vent valves suitable for use according to the present invention are conventionally available. Vent valve 104 is only indicated diagrammatically in FIGS. 1 and 5 so that certain other aspects of the invention may be more clearly illustrated. Vent valve 104 is spring biased so that seal 148 sealingly engages the wall of vent valve socket 120 unless fluid pressure within the pressure vessel 126 is sufficient to overcome the spring bias. When seal 148 is disengaged from its mating surface, the overpressure vent valve 104 allows fluid to escape from inside the vessel 126 and flows at least out of generally laterally extending pressure relief port 150 as indicated by fluid flow arrow 152. Fluid that flows out of this generally laterally extending pressure relief port 150 is generally dissipated along the exterior surface of the pressurized tank 126 where it was stored. In those configurations where normally exterior end 136 is not closed by some threaded connection or otherwise, vented fluid may also flow outwardly through normally exterior end 136 as indicated by fluid flow arrow 154. For safety's sake, it is generally desirable to dissipate as much fluid as possible along the generally lateral direction as indicated by fluid flow arrow 152.

Embodiments of a combination valve assembly may preferably comprise a valve housing member 102, an overpressure vent valve 104, a fill valve 106 and an overfill seal element 116. The valve housing member 102 may have a generally right cylindrical shape and include a first end 136, a second end 138 and a longitudinal axis 134 extending therebetween. The valve housing member 102 may have a vent valve socket 120, a fill valve socket 122, and an overflow channel 124. As illustrated in FIG. 5, for example, each of these sockets and channels may substantially extend from the second end 138 toward the first end 136. The overpressure vent valve 104 may be disposed within the vent valve socket 120 and have a pressure holding and a pressure relief configuration. The overpressure vent valve 104 may be elastically biased toward its pressure holding configuration. The elastic bias may be adapted to being overcome by a fluid pressure at the second end (e.g., the tank pressure) in excess of a pre-determined safe value (e.g., for the particular tank).

Figure 7:
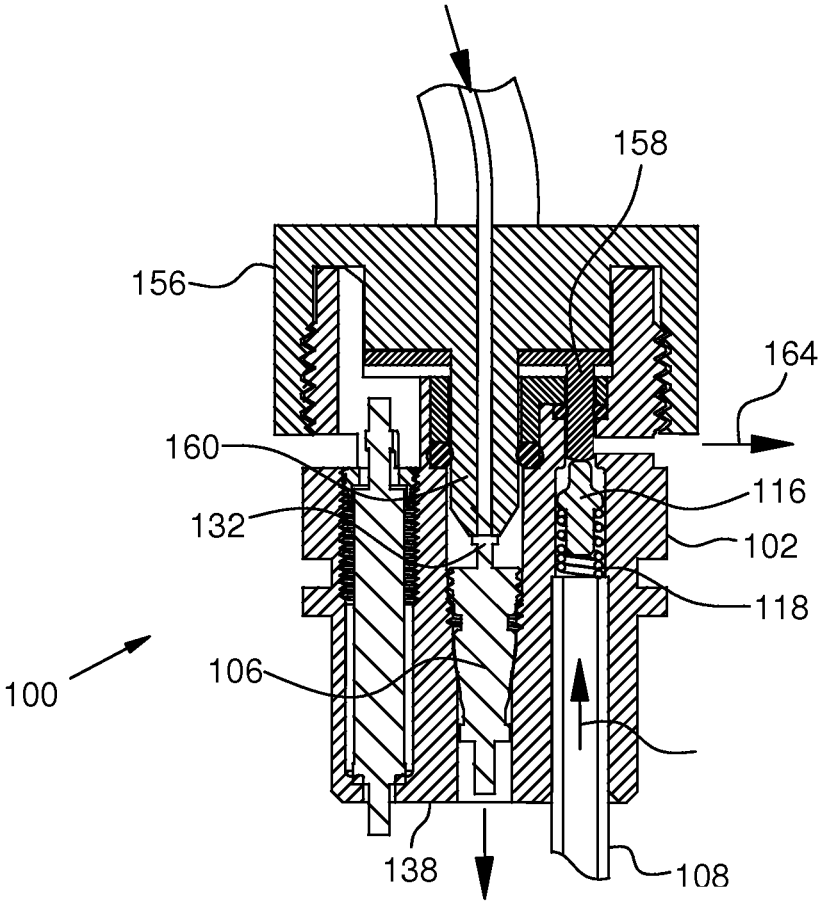
FIG. 7 is a diagrammatic cross-sectional view of one embodiment of a combination valve assembly, shown mated with one diagrammatic example of a fill adaptor during a fill operation.

The fill valve 106 may be disposed within the fill valve socket 122 and have a fill valve pin 132 actuatable between an open position (see, for example, FIG. 7) and a closed position (see, for example, FIG. 5). The fill valve 106 allows fluid to flow therethough when the fill valve pin 132 is in its open position. The fill valve 106 is adapted to prevent fluid from flowing therethough when the fill valve pin 132 is in its closed position. The fill valve pin 132 is spring biased toward its closed position. The overfill seal element 116 is preferably movable between a fluid sealing position (see, for example, FIG. 5) and a fluid releasing position (see, for example, FIG. 7). The overfill seal element 116 prevents fluid from flowing through the overfill channel 124 when in its fluid sealing position and allows fluid to flow through the overfill channel when in its fluid releasing position. The overfill seal element 116 is preferably resiliently biased toward its fluid sealing position. The aforementioned actuation of the fill valve pin 132 toward its open position and the movement of the overfill seal element 116 toward its fluid releasing position are preferably configured to both occur in a direction substantially parallel to the longitudinal axis 134 and toward the second end 138.

In certain embodiments, the resilient bias of the overfill seal element 116 is provided by a seal bias spring 118. In preferred embodiments in which a dip tube 108 is at least partially inserted within the overfill channel 124 and extending outwardly from the second end 138, the seal bias spring 118 may be axially secured within the overfill channel 124 at least in part by being disposed between the upper end of the dip tube 108 and the overfill seal element 116.

In particular preferred embodiments, such as the ones depicted in FIGS. 1 and 5, a combination valve assembly 100 may further comprise an annular seal element 110 and a second seal member 112. Referring to FIG. 5 for example, the annular seal element 110 may preferably be axially retained (e.g., restrained from movement in a direction parallel to the longitudinal axis 134) substantially between the fill valve 106 and the first end 136 in concentric alignment with the fill valve socket 122, and the second seal member 112 may be axially retained substantially between the overfill seal element 116 and the first end 136 in concentric alignment with the overfull channel 124. A guide element 114 may be affixed to the valve housing member 102 at least in part to provide such axial retention of the annular seal element 110 and second seal member 112. The guide element 114 may preferably be a unitary component made substantially of a polymer.

Embodiments may be adapted to accommodate propane fittings such as, for example, a CGA600 limited standard cylinder valve outlet connection. In such an embodiment the diameter of probe o-ring 110 may be generally adapted to create a seal between the o-ring and the nipple of an outlet connection, when such a connection is threadedly connected to the valve assembly.

Certain preferred embodiments in accordance with the present invention may enable the overfill channel 124, during a fill operation, to be opened and automatically seal simultaneously with the respective opening and closure of the inlet/outlet valve 106. By way of non-limiting example, a fill adaptor (such as the one depicted diagrammatically at 156 in FIG. 7) may be adapted to include a secondary protrusion element 158 capable of forcing the overfill seal element 116 into its fluid releasing position at the same time the fill valve 106 is forced open by the fill nozzle 160. Such an adaptor may, for example, include a bleed groove or port (not shown) allowing liquid propane to overflow from the overfill channel 124 (see arrow 162 for example) through the adaptor to the outside ambient environment when the liquid fill level limit in the tank has been reached. Alternatively, referring to FIG. 7 for example, a lateral bleed port formed in the valve housing member 102 may radially extend from externally of the housing 102 to a point within the overfill channel 124 between the overfill seal element 116 and the second seal member 112, thus allowing excess liquid from the overfill channel 124 to escape laterally of the housing 102 (see, for example, arrow 164) while the example fill adaptor 156 is attached to the valve housing 102. At the conclusion of the fill process, disengagement of respective portions of the fill adaptor from the combination valve assembly 100 could allow the overfill seal element 116 to automatically return to its fluid sealing position without requiring the operator to perform a secondary operation, such as installing or tightening a bleed set screw in the housing.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A combination valve assembly comprising:

a valve housing member having a generally right cylindrical shape and including a first end, a second end and a longitudinal axis extending therebetween, said valve housing member having a vent valve socket, a fill valve socket and an overfill channel, each substantially extending from said second end toward said first end;

a dip tube at least partially inserted within said overfill channel and extending outwardly of said second end;

an overpressure vent valve disposed within said vent valve socket and having a pressure holding and a pressure relief configuration, said overpressure vent valve being elastically biased toward its pressure holding configuration, said elastic bias adapted to being overcome by a fluid pressure at said second end in excess of a pre-determined safe value;

a fill valve disposed within said fill valve socket and having a fill valve pin actuatable between an open and a closed position, said fill valve allowing fluid to flow therethough when said fill valve pin is in its open position, said fill valve being adapted to prevent fluid from flowing therethough when said fill valve pin is in its closed position, said fill valve pin being spring biased toward its closed position; and an overfill seal element being movable between a fluid sealing position and a fluid releasing position, said overfill seal element preventing fluid from flowing through said overfill channel when in its fluid sealing position and allowing fluid to flow through said overfill channel when in its fluid releasing position, said overfill seal element being resiliently biased toward its fluid sealing position, said resilient bias being provided by a seal bias spring secured within said overfill channel, the seal bias spring being disposed between and in mutual axial alignment with said dip tube and said overfill seal element;

wherein said actuation of said fill valve pin toward its open position and said movement of said overfill seal element toward its fluid releasing position are configured to both occur in a direction substantially parallel to said longitudinal axis and toward said second end.

2. A combination valve assembly as defined in claim 1 further comprising an annular seal element and a second seal member, said annular seal element being axially retained substantially between said fill valve and said first end in concentric alignment with said fill valve socket, and said second seal member being axially retained substantially between said overfill seal element and said first end in concentric alignment with said overfill channel.

3. A combination valve assembly as defined in claim 2 further comprising a guide element affixed to said valve housing member at least in part to provide said axial retention of said annular seal element and said second seal member.

4. A combination valve assembly as defined in claim 3 wherein said guide element is a unitary component made substantially of a polymer.

* * * * *